United States Patent [19]

Hattori et al.

[11] Patent Number: 4,584,546

[45] Date of Patent: Apr. 22, 1986

[54] SWITCH FOR POWER WINDOWS

[75] Inventors: Masaichi Hattori, Nagoya; Shigeo Hara, Inuyama; Shunichi Manabe, Kagamihara, all of Japan

[73] Assignee: Kabushiki Kaisha Tokai Rika Denki Seisakusho, Japan

[21] Appl. No.: 730,187

[22] Filed: May 3, 1985

[30] Foreign Application Priority Data

May 8, 1984 [JP] Japan ..... 59-66038[U]

[51] Int. Cl.[4] ..... H01H 3/00; H01H 21/60

[52] U.S. Cl. ..... 335/186; 335/191; 335/164; 200/6 BB

[58] Field of Search ..... 335/186, 187, 189, 190, 335/191, 164, 165, 166; 200/68.2, 6 B, 6 BA, 6 BB

[56] References Cited

U.S. PATENT DOCUMENTS 4,376,896 3/1983 Takeda et al. ..... 307/115

4,408,105 10/1983 Tanaka ..... 200/68

*Primary Examiner*—Harold Broome

*Assistant Examiner*—Lincoln Donovan

*Attorney, Agent, or Firm*—Lowe, Price, LeBlanc, Becker & Shur

[57] ABSTRACT

A switch to be used for a power window of an automobile or the like is disclosed. It has a switch body. A knob is rotatably axially supported by the switch body. The knob has an accommodating chamber in its inside. A presser is accommodated within the chamber and biased downward by a spring. A pair of contact blades are positioned under the presser. Each of the contact blades is formed at its central portion with a V-shaped portion and inclined surfaces extending toward the right and left directions. The inclined surfaces are further extended to form contact portions. There is formed with a step between the inclined surfaces and the contact portions, so that a first step of operation and a second step of operation of the knob can be made without mistake. Stationary contacts are positioned corresponding to the contact portions. It also has a pair of contact holders. Each of the holders has a supporting piece folded upward from its one side. The supporting pieces contact the under surfaces of the inclined surfaces. A two way solenoid is connected to the knob to attract it in the both directions.

5 Claims, 7 Drawing Figures

SWITCH FOR POWER WINDOWS

BACKGROUND OF THE INVENTION

This invention relates to an improvement of a switch to be used for operating, for example, a power window of an automobile in which a window glass is actuated by a window reguator system driven by a reversible motor.

Heretofore, this kind of switch using a two way solenoid is disclosed in Japanese Utility Model Application Laid-Open-to-Public No. 56(1981)-22736 (Utility Model Application No. 54(1979)-104089). In this prior art, in the first step operation of a two step operation momentary type knob, the contact is closed according to the operating direction of the knob and the current flows into the two way solenoid. However, since the stroke of the knob is small in the first step of operation of the knob, the core cannot be attracted completely. Accordingly, when the operation of the knob is stopped, the core returns to its neutral position and the closing of the contact is resolved.

Also, in the second step of operation of the knob, since the core of the two way solenoid is set in a stroke as to be completely attracted, the knob is maintained in its operating state and the closing of the knob is also maintained. And, in this case, the resolving is made by breaking the current to the two way solenoid or by forcing the knob to return.

However, the one described in the above official gazette has such disadvantages as that since the member for regulating between the first step of operation and the second step of operation of the knob and the member for the contact are constituted of different members, the number of parts is large which results in high costs. In addition, it cannot be made small in its size as a whole.

SUMMARY OF THE INVENTION

The present invention is achieved in order to overcome the above mentioned disadvantages.

It is therefore a general object of the present invention to provide a switch wherein a member for regulating the first and second steps of operation of a knob and contact blades of a contact are commonly used thereby reducing the number of parts, decreasing the costs and diminishing the size.

In order to achieve the above object, there is essentially provided a switch comprising a switch body; a knob rotatably axially supported by said switch body and having an accommodating chamber therewithin; a presser accommodated within said accommodating chamber and having a pair of presser portions extending downward, said presser generally being spring loaded downward; an insulator housed in said switch body beneath said presser and having a pair of supporting chambers to have an opening toward said respective pair of presser portions; a pair of contact blades positioned between said presser and said insulator, each formed at its central portion with a V-shaped portion normally pressurized by said presser and with inclined surfaces extending toward the right and left directions from said V-shaped portion, said inclined surfaces being further extending toward the right and left directions to form contact portions through steps formed therebetween; stationary contacts positioned corresponding to said contact portions; a pair of contact holders each having a supporting piece folded upward from one side thereof, said supporting pieces contacting the under surfaces of said inclined surfaces at each side in such a manner as to hold the V-shaped portion therebetween; and a two way solenoid connected to said knob and adapted to attract in the both directions.

Numerous other objects, novel features and advantages of the present invention will be realized from the following detailed description of preferred embodiments of the invention. It is to be understood at the outset, however, that while the following description of preferred embodiments of the invention is directed to utilization of the present invention in connection with a power window regulator system of an automobile, several features and novel mechanisms of the invention may be employed in various other types of apparatuses which employ or require this type of switch using two way solenoid.

DETAILED DESCRIPTION OF THE EMBODIMENTS

Figure 1:
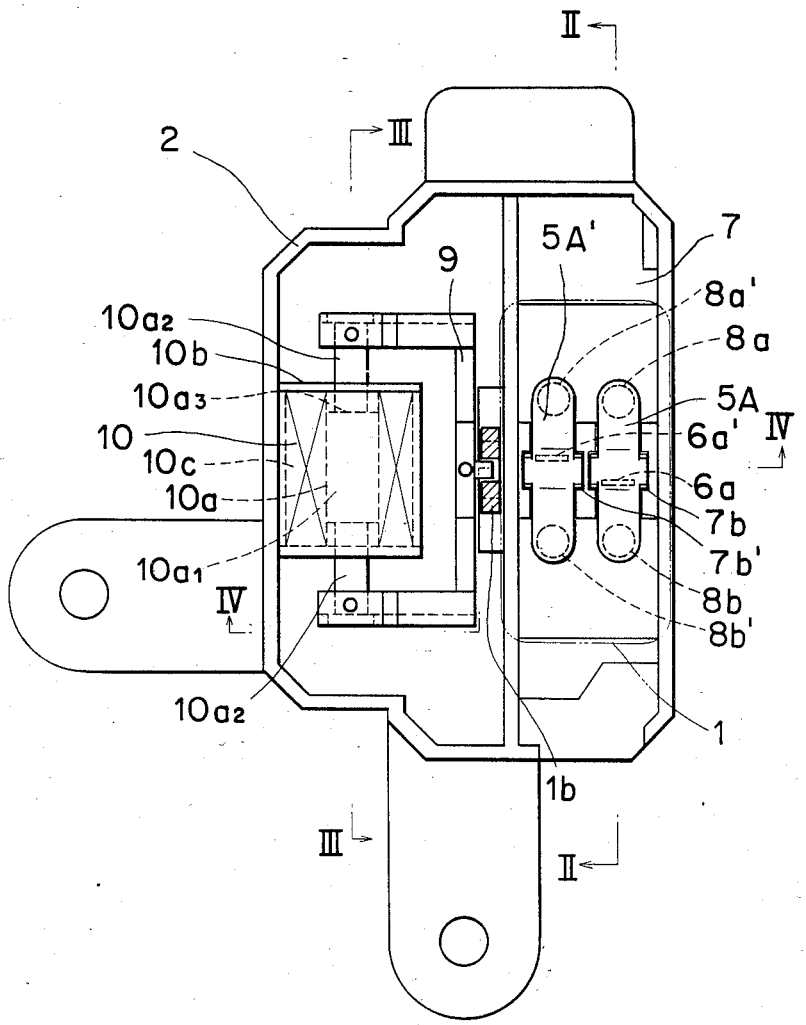
FIG. 1 is a plan view of a switch according to one embodiment of the present invention.

1 denotes a knob rotatably axially supported on a switch body 2. Accommodated within its central accommodating chamber 1*a* is a presser 3 which is formed at its lower portion in a fork shape serving as a pair of presser portions 3*a* and 3*b* extending downward. Said presser 3 is generally biased downward by a spring 4 stretched between said presser 3 and knob 1. As a result, the knob 1 is always maintained in its neutral position.

7 denotes an insulator housed in said switch body 2. Provided at the central portion of said insulator 7 is two supporting chambers 7*a* adjacent relative to each other and having an opening toward the presser portions 3*a* and 3*b*. Each of said supporting chambers 7*a* is firmly secured at its bottom portion with each of contact holders 6. Also, said supporting chambers 7*a* are firmly secured at the both right and left sides with a pair of stationary contacts 8*a* and 8*b*, and 8*a*′ and 8*b*′, respectively.

Figure 5:
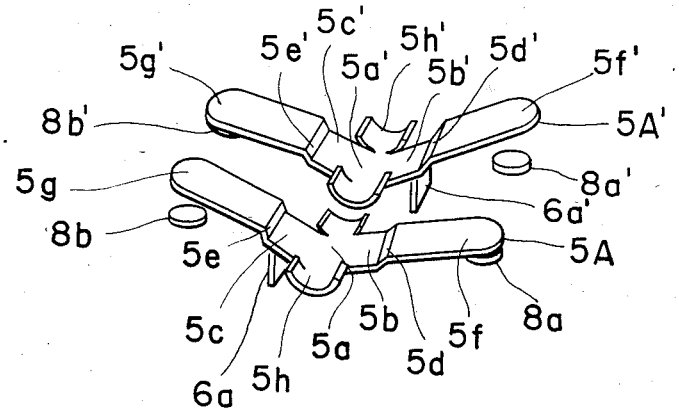
FIG. 5 is a perspective view of a contact blade.

5A and 5A′ denote contact blades provided between said presser 3 and said insulator 7 and including at the central portions V-shaped portions 5*a* and 5*a*′, inclined portions 5*b* and 5*b*′, and 5*c* and 5*c*′ extending rightward and leftward from said V-shaped portions 5*a* and 5*a*′, and contact portions 5*f* and 5*f*′, and 5*g* and 5*g*′, further extending therefrom through steps 5*d* and 5*d*′, and 5*e* and 5*e*′, respectively. Furthermore, said contact blades 5A and 5A′ are provided with guide portions 5*h* and 5*h*′ projecting forward and backward from said V-shaped portions 5*a* and 5*a*′, respectively (FIG. 5). And said guide portions 5*h* and 5*h*′ are inserted in groove portions 7*b* and 7*b*′ formed in the respective supporting chambers of the insulator 7. In this state, the V-shaped portions 5*a* and 5*a*′ are pressurized by the presser portions 3*a* and 3*b*, respectively. And, the contact portion 5f is disposed in such a manner as to correspond to the stationary contact 8a. Likewise, the contact portion 5g corresponds to the stationary contact 8b, the contact portion 5f corresponds to the stationary contact 8a', and the contact portion 8a' corresponds to the stationary contact 8b', respectively. The contact holders 6 firmly secured to the bottom surface of the supporting chambers 7a are folded upward at one sides to form supporting pieces 6a and 6a', respectively. One of the contact pieces 6a is positioned at the under surface of the inclined portion 5c of the contact blade 5A, and the other contact piece 6a' is positioned at the under surface of the inclined portion 5b' of the contact blade 5A'. Accordingly, when the V-shaped portions 5a and 5a' are pressurized at the central portions thereof by the presser 3, the contact blade 5A is inclined rightward to have the contact portion 5f contact with the stationary contact 8a, and the contact blade 5A' is inclined leftward to have the the contact portion 5g' contact with the stationary contact 8b', respectively.

Figure 2:
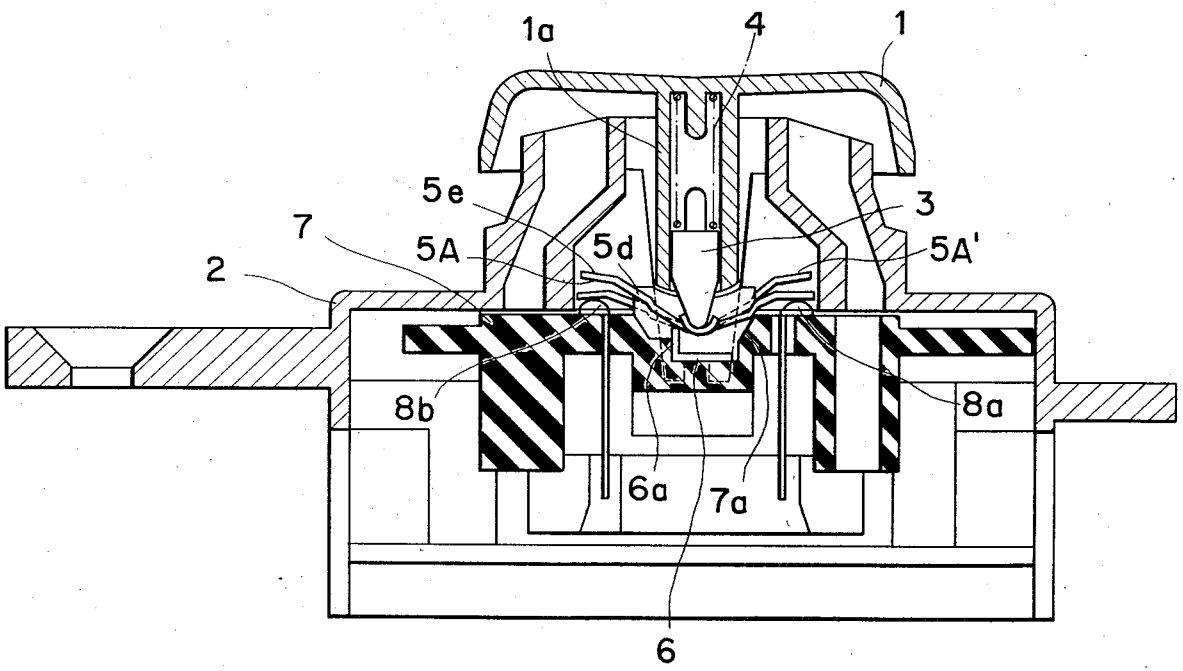
FIG. 2 is a sectional view taken along line II—II of FIG. 1.
Figure 3:
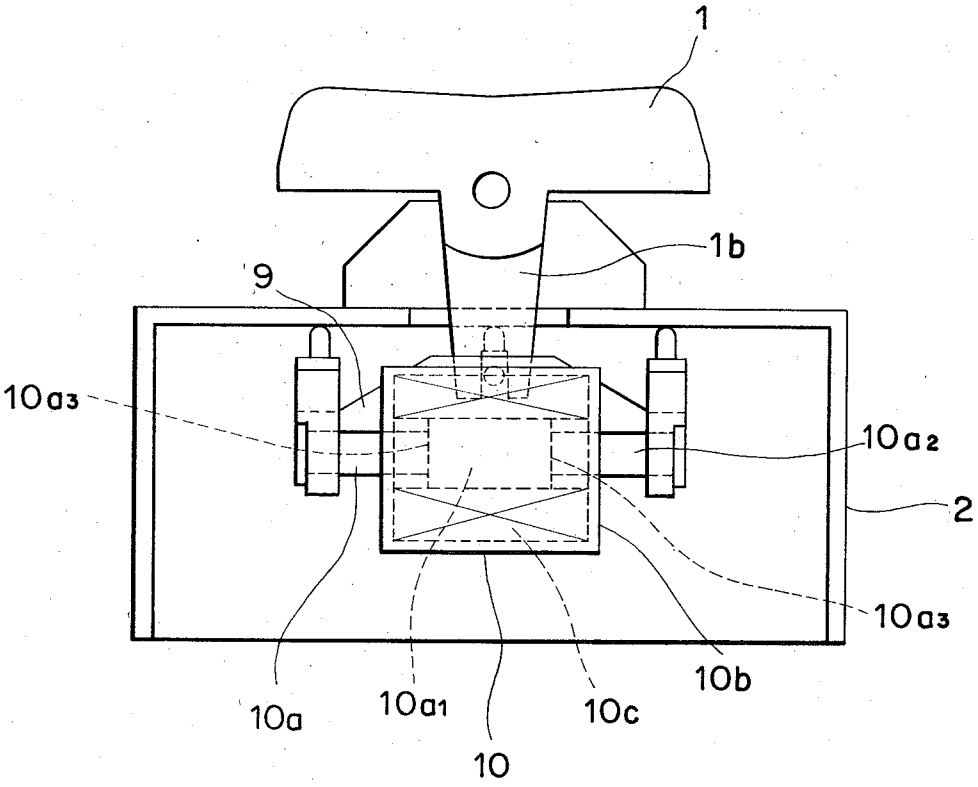
FIG. 3 is likewise a sectional view taken along line III—III.
Figure 4:
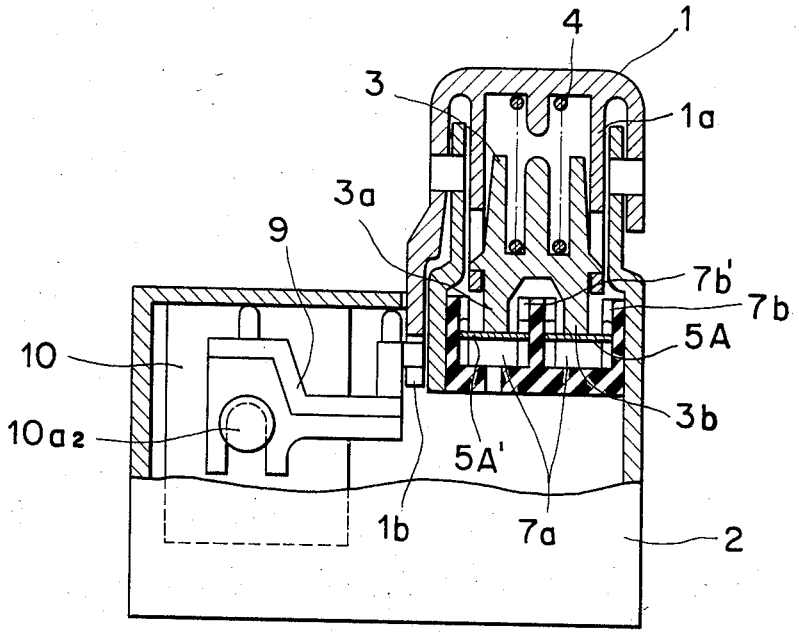
FIG. 4 is likewise a sectional view taken along line IV—IV.

Now, when the knob 1 is operated to be inclined toward one direction, rightward in FIG. 2 for example, the respective presser portions 3a and 3b are moved on the inclined portions 5c and 5c'. And, then the presser portions 3a and 3b are moved and passed the position of the supporting piece 6a of the contact holder 6, the contact blade 5A is inclined to the other side. That is, the contact blade 5A is pivoted about the supporting piece 6a and the contact portion 5g is contacted with the stationary contact 8b at the other side to switch the contact. In the foregoing state, the other contact blade 5A' is not activated.

Likewise, when the knob 1 is inclined in the other direction, the contact blade 5A is not activated. When said presser portion 3b' passes the supporting piece 6a' at the inclined portion 5b' of the contact blade 5A', the contact blade 5A' is inclined to the other side, and the contact portion 5f' is contacted with the stationary contact 8a' to switch the contact.

Since the respective contact blades 5A and 5A' are formed with the steps 5d and 5d', and 5e and 5e', the presser 3 is required to overcome said steps in order to operate the knob 1 even further. This resistance serves as a regulation for the further operation (second step of operation) of the knob 1.

Although the contact positions between the respective presser portions 3a and 3b of the presser 3 and the contact blades 5A and 5A' are changed by the operation of the knob 1 as described above, the presser 3 is applied with force to be returned to its neutral position due to the biasing force of the spring 4 with respect to the presser 3.

Nextly, the holding mechanism of the knob 1 will be described.

The knob 1 is provided with a hanging arm 1b hanging downward from its one side. The tip portion of said arm 1b is connected to a core 10a of a two way solenoid 10 through a card 9.

The two way solenoid 10 comprises a yoke 10b formed in a generally yoke shape, a coil 10c disposed within said yoke 10b, and a core 10a. The large diameter portion of said core 10a is contained within the coil 10c and the small diameter portion thereof is projected from the both front and back faces of said yoke 10b.

Figure 6:
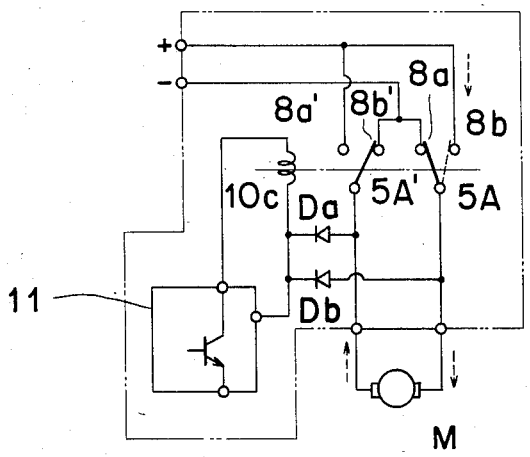
FIG. 6 is a circuit diagram.

A circuit constituted with said coil 10c and contact blades 5A and 5A' is shown in FIG. 6, wherein Da and Db denote diodes, 11 denotes a holding circuit, and M denotes a motor.

Now, when the knob 1 is pressed for operation at its one side (right side), the respective presser portions 3a and 3b of the presser 3 are moved on the inclined surfaces 5c and 5c' of the contact blades 5A and 5A', respectively. As a result, one of the contact blades 5A is, as described above, rotated reversely to switch the contact. That is, the contact 5g is caused to contact with the stationary contact 8b. And its presser portion 3a hits the step 5e and is stopped at that position, and the first step of operation is made. In this state, the contact blade 5A' is not actuated as described.

In this way, when, for example, the contact blade 5A is switched as shown by the dotted line, a current flows into the motor M as shown by the dotted line. As a result, the motor M is rotated to move, for example, the window downward.

And the operation of said knob 1 causes the hanging arm 1b to be rotated to move the core 10a toward one direction through the card 9. Simultaneously, the current flows into the coil 10c through the diode Db and the holding circuit 11. As a result, the coil 10c is excited to hold the core 10a in a position already moved.

However, since the step $10a_3$ of the core 10a is not contacted with the yoke 10b at this time and the attracting force of the coil 10c is small, when the operating force of the knob 1 is resolved, the returning force of said presser 3 due to the spring 4 wins the attracting force of the core 10a and the knob 1 is returned to its initial position.

At the same time, the contact blade 5A is rotated reversely and returned to a position as shown by the solid line in FIG. 6. Therefore, the current flowing into the coil 10c and the holding circuit 11 is broken, and the motor M is also stopped. As a result, the downward movement of the window is stopped.

On the contrary, when the knob 1 is operated to such extent as to let the presser 3 overcome the step 5e, the contact of the contact blade 5A is switched in the same manner as described in the foregoing, and the downward movement of the window is performed due to the rotation of the motor M. That is, the current is supplied to the diode Db, coil 10c and holding circuit 11.

And, as the angle of rotation of the hanging arm 1b of the knob 1 becomes even larger, the moving amount of the core 10a becomes larger. As a result, since the step $10a_3$ hits the yoke 10b, the attracting force for the core 10a becomes even stronger, and defeats the biasing force of the spring 4 with respect to the presser 3 to maintain the rotating state of the knob 1.

And, when the holding circuit 11 breaks the current because of the completion of the downward movement, etc., since the current flowing into the coil 10c is broken, the knob 1 is returned to its initial position owing to the biasing force of the spring 4, the contact blade 5A is rotated reversely, and the motor M is stopped.

When the motor M is required to be stopped in the process of its downward movement, the knob 1 is forcedly returned. Then, the contact blade 5A is rotated reversely and the contact is switched. As a result, the motor M is stopped and the current flowing into the coil 10c is also broken.

Although a knob operation for moving, for example, the window downward was described in the foregoing, the reverse operation of the knob, i.e., for the upward movement of the power window, can be made in the same manner as described.

Figure 7:
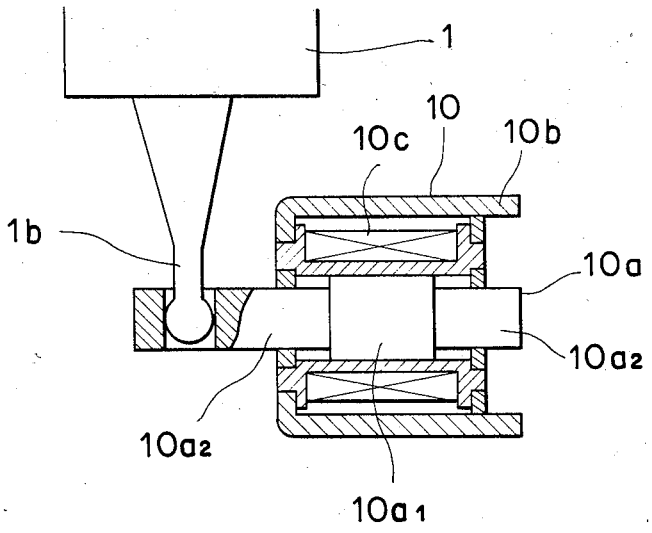
FIG. 7 is a partly sectional view of another embodiment.

FIG. 7 illustrates another embodiment wherein the knob 1 is directly connected to the core 10a instead of through the card 9. Since its motion is same as that of the preceeding embodiment, a duplicate description will be avoided.

As described in the foregoing, according to the present invention, the first step of operation and the second step of operation can be regulated by providing a step in the intermediate portion of the inclined surface of the contact blade. Thus, the two kinds of operation can be made without mistake.

And, since said step is provided on the contact blade including contacts, the number of parts required is less compared with those in which the regulating members and the contacting members are separately constituted. As a result, the cost reduction can be achieved.

Also, since the two spaces, one for the regulating use and the other for the contacting use, are concentrated in one, the space can be reduced, and the size can be made small. The switch according to the present invention is particularly suitable when applied to the power window regulator system of an automobile, turn signal, sun roof, etc. which cannot afford to spend a large space for installation.

Furthermore, since the number of parts is small, the proberbility of disorder can be diminished and a reliability can be improved.

It is contemplated, of course, that numerous modifications, changes and/or additions may be made to the switch of the present invention without departing from the spirit of the present invention. Accordingly, it is intended that this patent be limited only by the scope of the appended claims.

What is claimed is:

1. A switch assembly comprising a switch body;

a knob rotatably axially supported by said switch body and having an accommodating chamber therewithin;

a presser accommodated within said accommodating chamber and having a pair of presser portions extending downward, said presser generally being spring loaded downward;

an insulator housed in said switch body beneath said presser and having a pair of supporting chambers to have an opening toward said pair of presser portions;

a pair of contact blades positioned between said presser and said insulator, each formed at its central portion with a V-shaped portion normally pressurized by said presser and with inclined surfaces extending toward the right and left directions from said V-shaped portion, said inclined surfaces being further extending toward the right and left directions to form contact portions through steps formed therebetween; stationary contacts positioned corresponding to said contact portions;

a pair of contact holders each having a supporting piece folded upward from one side thereof, said supporting pieces contacting the under surfaces of said inclined surfaces at each side in such a manner as to hold the V-shaped portion therebetween; and a two way solenoid connected to said knob and adapted to attract in the both directions.

2. A switch according to claim 1, wherein said two supporting chambers of the insulator are provided at its central portion thereof and adjacent relative to each other.

3. A switch according to claim 1, wherein each of said contact blades are formed with a guide portion projecting forward and backward therefrom.

4. A switch according to claim 1, wherein said knob is provided with a hanging arm hanging downward therefrom.

5. A switch according to claim 4, wherein said hanging arm is connected at its tip portion with a core of said two way solenoid through a card.

* * * * *